US006336503B1

(12) United States Patent
Alhanati et al.

(10) Patent No.: US 6,336,503 B1
(45) Date of Patent: Jan. 8, 2002

(54) DOWNHOLE SEPARATION OF PRODUCED WATER IN HYDROCARBON WELLS, AND SIMULTANEOUS DOWNHOLE INJECTION OF SEPARATED WATER AND SURFACE WATER

(75) Inventors: Francisco Alhanati, Edmonton; Ryan Chachula, Calgary; Cam Matthews, Edmonton; Kelly Piers, Edmonton; Sandeep Solanki, Edmonton; Todd Zahacy, Edmonton, all of (CA)

(73) Assignee: Pancanadian Petroleum Limited, Calgary (CA)

( * ) Notice: Subject to any disclaimer, the term of this patent is extended or adjusted under 35 U.S.C. 154(b) by 0 days.

(21) Appl. No.: 09/519,390

(22) Filed: Mar. 3, 2000

(51) Int. Cl.[7] ..... E21B 43/34

(52) U.S. Cl. ..... 166/265; 166/105; 166/106; 166/313

(58) Field of Search ..... 166/265, 313, 166/105, 106, 372

(56) References Cited

U.S. PATENT DOCUMENTS

| | | | | |
|---|---|---|---|---|
| 3,718,407 A | | 2/1973 | Newbrough | |
| 4,251,191 A | | 2/1981 | Gass et al. | |
| 4,386,654 A | * | 6/1983 | Becker | 166/105.5 |

(List continued on next page.)

FOREIGN PATENT DOCUMENTS

| | | |
|---|---|---|
| GB | 2194575 | 3/1988 |
| GB | 2203062 | 10/1988 |
| GB | 2308995 | 7/1997 |
| WO | WO8603143 | 6/1986 |
| WO | WO9413930 | 6/1994 |
| WO | WO95/07414 | 3/1995 |
| WO | WO98/13579 | 4/1998 |
| WO | WO00/03118 | 1/2000 |

OTHER PUBLICATIONS

Bortolin, L., Maraven, S.A., Johnson, K. J. and Bechtold, H. D., "Use of Reeled Tubing in Gas Lift Completion Systems", Presented at the 2nd Latin American Petroleum Engineering Conference, Venezuela, Mar. 1992, SPE 23749, pp. 467–474.

Winkler, H.W., "Petroleum Engineering Handbook", SPE Publication 1987, pp. 5–1 to 5–57.

Brown, K.E., "Overview of Artificial Lift Systems", Journal of Petroleum Technology, 1982, SPE 9979, pp. 2384–2396.

Edwards, R., Marshall, D. L. and Wade, K. C., Baker–Jardine & Assocs. Ltd., "A Gas–Lift Optimization and Allocation Model for Manifolded Subsea Wells", Presented at the European 90, 1990, SPE 20979, pp. 535–545.

(List continued on next page.)

*Primary Examiner*—Hoang Dang
(74) *Attorney, Agent, or Firm*—Brian W. Gray

(57) ABSTRACT

A method and system for the downhole separation and injection of surface water and water contained in a produced mixture from an underground formation of a hydrocarbon well containing hydrocarbon and water. Downhole separation of the produced mixture into a predominately water component and predominately hydrocarbon component is achieved using an oil-water separator. Surface water is delivered to a downhole fluid-driven pump under pressure so as to drive the pump. The downhole-separated predominately water component of the produced mixture is directed to the pump, by way of the pump and combined with surface water to obtain a combined fluid. The combined fluid is directed to a downhole injection formation by way of the pump. Oil is transported to the head of the well either naturally under the eruptive force of the well, or with the assistance of regular artificial lift methods, including gas-lift. This invention allows for injection of surface water and downhole-separated water in the same wellbore while producing oil to surface.

9 Claims, 2 Drawing Sheets

U.S. PATENT DOCUMENTS

| | | | | | |
|---|---|---|---|---|---|
| 4,770,243 | A | | 9/1988 | Fouillout et al. | |
| 4,793,408 | A | * | 12/1988 | Miffre | 166/53 |
| 4,805,697 | A | * | 2/1989 | Fouillout et al. | 166/265 |
| 5,217,067 | A | | 6/1993 | Landry et al. | |
| 5,296,153 | A | * | 3/1994 | Peachey | 210/787 |
| 5,456,837 | A | | 10/1995 | Peachey | |
| 5,482,117 | A | | 1/1996 | Kolpak et al. | |
| 5,570,744 | A | | 11/1996 | Weingarten et al. | |
| 5,711,374 | A | * | 1/1998 | Kjos | 166/265 |
| 5,730,871 | A | | 3/1998 | Kennedy et al. | |
| 5,813,469 | A | * | 9/1998 | Bowlin | 166/369 |
| 5,830,368 | A | | 11/1998 | Peachey | |
| 5,857,519 | A | * | 1/1999 | Bowlin et al. | 166/105.5 |
| 5,860,476 | A | | 1/1999 | Kjos | |
| 5,988,275 | A | | 11/1999 | Brady et al. | |
| 6,017,456 | A | * | 1/2000 | Kennedy et al. | 210/512.2 |
| 6,026,901 | A | | 2/2000 | Brady et al. | |
| 6,082,452 | A | * | 7/2000 | Shaw et al. | 166/105.5 |
| 6,089,317 | A | | 7/2000 | Shaw | |
| 6,092,600 | A | * | 7/2000 | McKinzie et al. | 166/266 |
| 6,138,758 | A | * | 10/2000 | Shaw et al. | 166/265 |
| 6,173,774 | B1 | * | 1/2001 | Fox | 166/265 |
| 6,189,613 | B1 | | 2/2001 | Chachula | |
| 6,202,744 | B1 | | 3/2001 | Shaw | |
| 6,213,208 | B1 | | 4/2001 | Skilbeck | |

OTHER PUBLICATIONS

Glass, E. D., "Continuous Gas–Lift Theory", Society of Petroleum Engineers, Tulsa, Oklahoma, 1975, SPE 5458, pp. 1–7.

Lea, J. F. and Winkler, H. W., "What's New in Artificial Lift", World Oil, May 1993, pp. 41–46.

Moore, B. K., Laflin, W. J. and Walker, E.J., "Rigless Completions: A Spoolable Coiled–Tubing Gas–Lift System", Presented at the 25$^{th}$ Annual OTC, Houston, TX, May 1993, OCT 7321, pp. 597–602.

Moore, P. C. and Adair, P., "Dual Concentric Gas–Lift Completion Design for the Thistle Field", SPE Production Engineering, SPE 18391, Feb. 1991, pp. 102–108.

Nieberding, M. A., Schmidt, Z., Blais, R. N. and Doty, D. R., "Normalization of Nitrogen–Loaded Gas–Lift Valve Performance Data", SPE Production & Facilities, Aug. 1993, pp. 203–210.

Osuji, L. C., "Review of Advances in Gas Lift Operations", Society of Petroleum Engineers, May 1994, SPE 28292, pp. 1–12.

Walker, E. J., Hendrix, J. L., Humphrey, K. J., Moore, B. K. and Whitlow, R. R., "A Spoolable Coiled–Tubing Gas–Lift Completion System", Presented at the the 66$^{th}$ Annual Technical Conference and Exhibition, Houston, TX, Oct. 1993, SPE 26538, pp. 291–301.*

Winkler, H. W., "Misunderstood or Overlooked Gas–Lift Design and Equipment Considerations", Presented at the University of Tulsa Centennial Petroleum Engineering Symposium, Tulsa, Oklahoma, Aug. 1994, SPE 27991, pp. 351–361.*

Peavy, M.A.; Fahel, R.A., "Artificial Lift with Coiled Tubing for Flow Testing the Monterey Formation, Offshore California", SPE Production Engineering, May 1991, SPE 20024, pp. 142–146.*

International Search Report mailed Aug. 7, 2001 in connection with International Application No. PCT/CA01/00260.

International Search Report mailed Aug. 6, 2001 in connection with International Application No. PCT/CA01/00263.

* cited by examiner

DOWNHOLE SEPARATION OF PRODUCED WATER IN HYDROCARBON WELLS, AND SIMULTANEOUS DOWNHOLE INJECTION OF SEPARATED WATER AND SURFACE WATER

BACKGROUND OF THE INVENTION

1. Field of the Invention

The present invention is generally directed to a method and system for the downhole injection to an injection formation of surface water and downhole-separated water contained in produced fluids from a production formation of a hydrocarbon well.

2. Background

Produced fluid from hydrocarbon wells can contain a high percentage of water (also referred to as water cut) mixed with hydrocarbon. For example, a large number of oil fields are produced by injecting water to maintain voidage replacement and aid in flooding the oil zone toward the producing wellbore. The wells in these fields tend to produce significant amounts of water. In typical practice, the produced fluids are lifted to the surface where they are processed to separate water from hydrocarbon. The separated water must be subsequently disposed of at the surface or re-injected into a subterranean formation using designated injection wells. As the field matures and water cut increases, operating and disposal costs generally increase while oil production declines.

In many wells, it might be more economical to implement a downhole system to separate the water from the produced fluids in the wellbore instead of producing the produced fluids to the surface, then re-injecting the downhole-separated water into another downhole formation accessible through the same wellbore. Methods for the downhole disposal of water contained in produced fluids have been recently developed. Examples of these methods can be found in patents including WO86/03143; U.S. Pat. Nos. 4,805,697; 5,296,153; 5,456,837; 5,711,374; and 5,730,871; in which separation means are provided downhole to separate the oil and water contained in the produced fluids. These methods rely on downhole pumps to re-inject the downhole-separated water into a suitable zone and to produce the oil to the surface.

Recently, an approach that allows for simultaneous injection of water from surface and hydrocarbon production in a single wellbore was disclosed in U.S. Pat. No. 5,813,469. The apparatus includes a first pump coupled to a second pump. The first pump is powered by pressurized fluid that is injected down the wellbore. The second pump is used to pressurize the produced fluids allowing them to flow to the head of the well and is powered by the first pump. Water contained in the produced fluids flow, together with the hydrocarbon, to the surface.

SUMMARY OF THE INVENTION

What is required is a method and system for the downhole separation of water from the produced fluids of a production zone of a hydrocarbon well, and simultaneous injection of the downhole-separated water with surface water, in the same wellbore. Accordingly, the present invention concerns a method and system for the downhole separation of water from the produced fluids of a production zone of a well producing a hydrocarbon and water mixture from an underground formation.

According to an aspect of the present invention, in a well producing a hydrocarbon and water mixture from an underground formation, there is provided a method of separating and injecting downhole water from the produced mixture comprising the steps of delivering surface water to a downhole fluid-driven pump under pressure so as to drive the pump, separating the mixture obtained from the formation into a predominately water component and a predominately hydrocarbon component and directing the predominately water component to the pump, by way of the pump and combining the surface water and predominately water component to obtain a combined fluid. The combined fluid is directed into a downhole injection formation by way of the pump.

In accordance with a preferred embodiment of the present invention, the mixture obtained from the formation is at least 20% water.

In accordance with yet another preferred embodiment of the present invention, surface water is delivered to the downhole pump through the interior of a dedicated tube extending between the surface and the pump. In accordance with yet another preferred embodiment, surface water is delivered to the pump by way of an annular space located within the well.

In accordance with yet another preferred embodiment of the present invention, surface water is pressurized with the use of a pump located at the surface.

In accordance with another preferred embodiment of the present invention, a separator that separates liquids of different densities is used downhole to separate the produced mixture into a predominately water component and a predominately hydrocarbon component.

In accordance with yet another preferred embodiment of the present invention, the downhole separator comprises one or more than one cyclone separator wherein liquids of different densities are separated.

In accordance with yet another preferred embodiment of the present invention, the predominately hydrocarbon component is delivered to the surface of the well through a dedicated tube within the wellbore or through an annular space located within the wellbore.

In accordance with yet another preferred embodiment of the present invention, delivery of the predominately hydrocarbon component to the surface includes the use of an artificial lift system. This artificial lift system may be selected from a group consisting of gas-lift systems, beam pump systems, progressive cavity pump systems, electrical submersible pump systems, and hydraulic pump systems.

In accordance with yet another preferred embodiment of the present invention, the producing formation may be above the injection formation. In another embodiment of the present invention, the producing formation is located below the injection formation.

In accordance with yet another preferred embodiment of the present invention, the separator is located below the producing formation. In accordance with yet another preferred embodiment of the present invention, the separator is located above the producing formation.

In accordance with another aspect of the current invention, there is provided, in a well producing a hydrocarbon and water mixture from an underground formation, a system for the downhole separation and injection of water contained in the produced mixture comprising an oil-water separator for separating the produced mixture into a predominately hydrocarbon component and a predominately water component, and having at least one inlet to receive the produced mixture, at least one outlet for the predominately hydrocarbon component of the mixture to pass from the separator. The system further comprises at least one outlet for the predominately water component of the mixture to pass from the separator; and a downhole fluid-driven pump for receiving surface water under pressure so as to drive the pump and that is in fluid communication with the separator outlet for the predominately water component of the produced mixture to permit combination of the predominately water component and the surface water as a combined fluid, and comprising an outlet oriented to permit direction of the combined fluid into a downhole formation.

In accordance with a preferred embodiment of the invention, the system further comprises a tube extending from the surface of the well to the downhole pump for the delivery of surface water to the pump. This tube can be a dedicated tube which isolates the surface water within the casing of the well or an annular space formed within the casing of the well and in fluid communication with the downhole pump. The annular space need not be perfectly annular in shape.

In accordance with yet another preferred embodiment of the present invention, the system further comprises a pump located at the surface for delivering surface water to the downhole pump under pressure.

In accordance with yet another preferred embodiment of the present invention, the system further comprises a dedicated conduit for delivery of the predominately hydrocarbon component of the produced mixture to the surface. The conduit is in fluid communication with the separator outlet for the predominately hydrocarbon component of the produced mixture and extends to the surface of the well.

In accordance with yet another preferred embodiment of the present invention, the system further comprises an annular space within the wellbore for delivery of the predominately hydrocarbon component of the produced mixture to the surface. The annular space is in fluid communication with the separator outlet for the predominately hydrocarbon component of the produced mixture and extends to the surface of the well.

In accordance with yet another preferred embodiment of the present invention, the system further comprises a water disposal string for delivery of combined fluids from the fluid-driven pump to the injection formation.

In accordance with yet another preferred embodiment of the present invention, an artificial lift system is used to aid in delivering the hydrocarbon component to the surface. In accordance with yet another preferred embodiment of the present invention, the artificial lift system is selected from a group consisting of gas-lift systems, beam pump systems, progressive cavity pump systems, electrical submersible pump systems, and hydraulic pump systems.

In accordance with yet another preferred embodiment of the present invention, the fluid-driven pump is selected from a group consisting of jet pumps, progressive cavity pumps, turbine pumps, and reciprocating pumps.

In accordance with yet another preferred embodiment of the present invention, the fluid-driven pump comprises a pump and a motor.

In accordance with yet another preferred embodiment of the present invention, the oil-water separator comprises one or more cyclones housed in one or more than one separator, the cyclones acting in parallel or in series.

In accordance with yet another preferred embodiment of the present invention, the fluid-driven pump is located inside the same housing as the oil-water separator.

With the method and system of the present invention, surface water and downhole-separated water is injected downhole with the use of a downhole fluid-driven pump that uses surface water as a power fluid. Hydrocarbon is brought to the surface either naturally under the eruptive force of the production zone, or with the assistance of regular artificial lift methods such as gas-lift. With the present system, downhole-separated oil and surface water can be transported through the wellbore in either a conduit or annular space located within the wellbore. This variable tubing configuration allows for optimizing the flow of fluids in the wellbore. Potential benefits of this invention includes increased hydrocarbon production, reduced operating costs due in part to reduced power consumption and reduced handling of water at the surface; reduced capital costs by alleviating the need to drill separate wells for downhole injection of water; and improved oil-water separation conditions by locating the oil-water separator downhole. Another advantage of the present invention is the use of a single fluid-driven pump downhole. Such pumps can be more reliable than electrical pumps and mechanical pumps downhole and do not require rod or cable connections to surface.

Other and further advantages and features of the invention will be apparent to those skilled in the art from the following detailed description thereof, taken in conjunction with the following drawings.

BRIEF DESCRIPTION OF THE DRAWINGS

These and other features of the present invention are more fully set forth in the following description of illustrative embodiments of the invention. The description is presented with reference to the accompanying drawings in which.

DETAILED DESCRIPTION OF PREFERRED EMBODIMENTS

The description which follows, and the embodiments described therein, are provided by way of illustration of an example, or examples of particular embodiments of the principles of the present invention. These examples are provided for the purpose of explanation, and not limitation, of those principles and of the invention.

Figure 1:
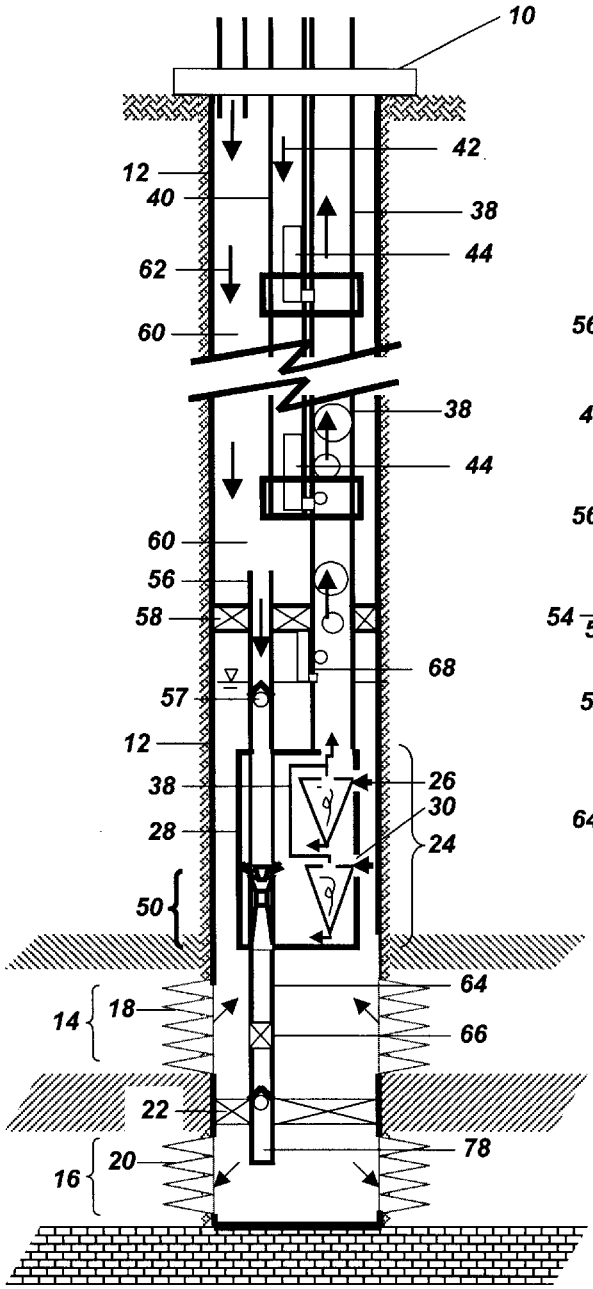
FIG. 1 shows a schematic representation of an embodiment of the present invention in which the predominately hydrocarbon component of the produced mixture is delivered to the head of the well by way of a conduit extending from the separator to the head of the well, and surface water is delivered to a downhole fluid-driven pump by way of an annular space located within the well.
Figure 2:
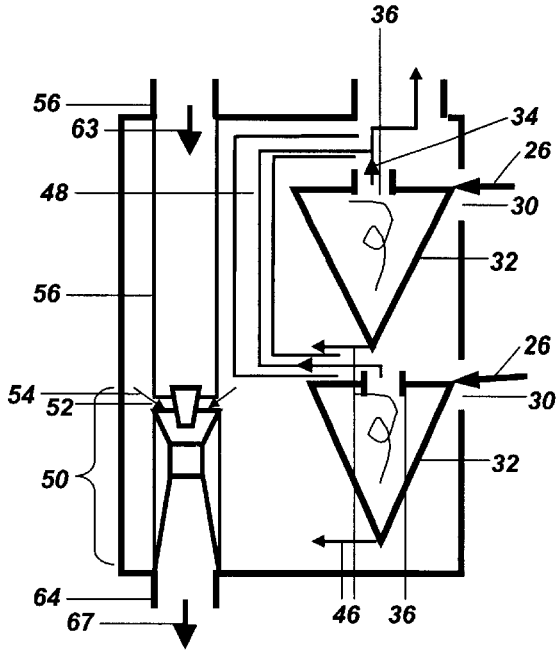
FIG. 2 shows a schematic representation of an embodiment of the downhole separator and fluid-driven pump in FIG. 1.
Figure 3:
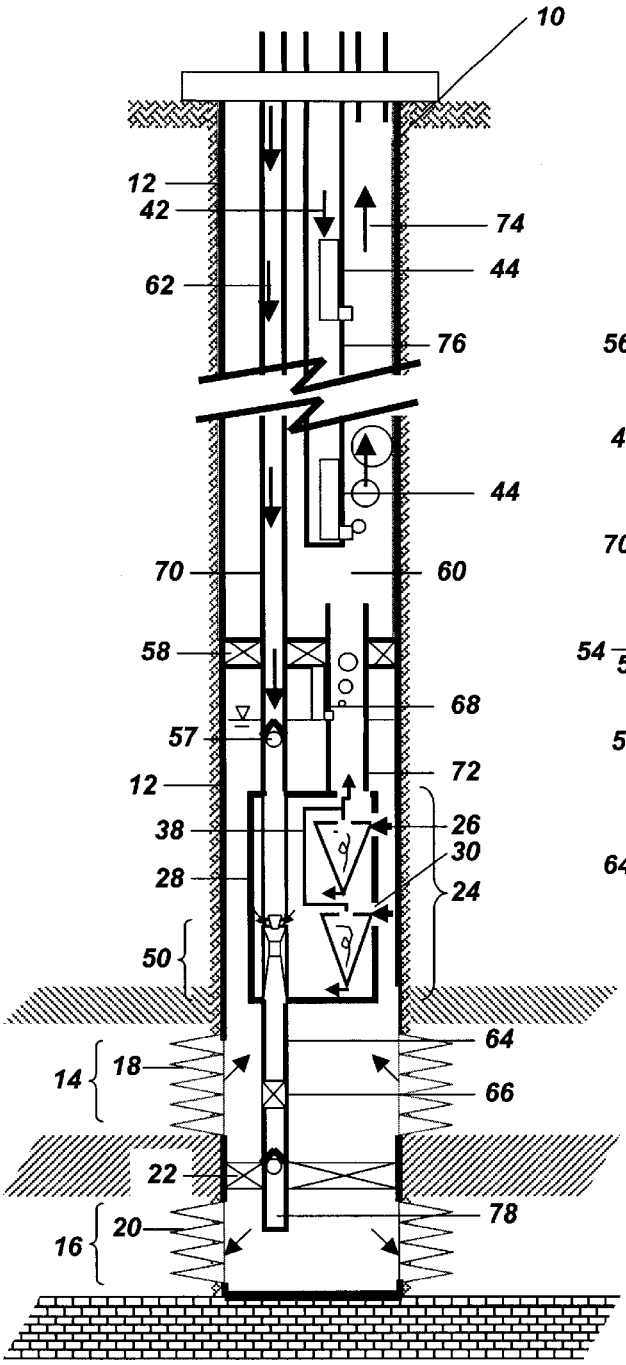
FIG. 3 shows a schematic representation of an embodiment of the present invention in which surface water is delivered to a downhole pump by way of a tube extending from the head of the well to the pump, and the predominately hydrocarbon component of the produced mixture is delivered to the head of the well by way of an annular space located within the well.
Figure 4:
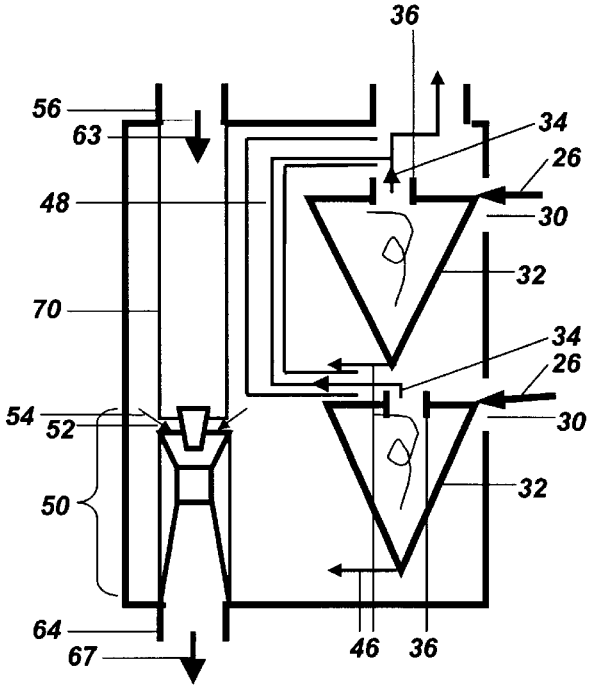
FIG. 4 shows a schematic of an embodiment of the separator and pump shown in FIG. 2.

With reference to FIG. 1 and FIG. 3, there is shown hydrocarbon production well 10 having wellbore casing 12 that penetrates at least one production zone 14 and at least one injection zone 16. Production perforations 18 in wellbore casing 12 are provided in the area of production zone 14 to allow for intake of produced fluids from production zone 14. Injection perforations 20 in wellbore casing 12 are provided in the area of injection zone 16 to permit injection of water into injection zone 16. Injection zone 16 may be above or below production zone 14. Lower annular sealing packer 22 isolates production zone 14 from injection zone 16. Oil-water separator 24 for separating the produced fluids mixture from production zone 14 into a predominately hydrocarbon component and a predominately water component is located within wellbore casing 12. In the embodiments of FIG. 1 through FIG. 4 the oil-water separator has been illustrated as a simple schematic and one skilled in the art will appreciate that the oil-water separator is more complicated. Also, in the embodiments, the oil-water separator is placed downhole and above production zone 14. It is possible for the separator to be located above or below the production zone. Placing the oil-water separator below the production zone reduces the free gas entering the oil-water separator and can result in improved oil-water separation. Placing the oil-water separator above the production zone can result in an increase in free gas entering the oil-water separator. In that event, employing at least one gas-liquid separator in combination with the oil-water separator to remove free gas from produced fluids may be useful. Such separators are known to one of ordinary skill in the art.

In FIG. 1, total produced fluids, flowing the direction indicated by arrows 26, enter oil-water separator 24. Oil-water separator 24 is shown in FIG. 2 and includes two inflow ports 30 that are in fluid communication with two cyclones 32 operating in parallel that separate produced fluids 26 into a predominately hydrocarbon component and a predominately water component. Alternative arrangements for separating produced fluids into a predominately hydrocarbon component and a predominately water component will be apparent to those skilled in the art. For example, the number and types of cyclones can vary in capacity and diameter. In another embodiment, the oil-water separator can incorporate a pull through design, with the inlet stream of all cyclones ported to the outside of the separator, and with all outlets for the predominately hydrocarbon component of produced fluids to pass from the separator connected to a common tube for delivery of the mostly hydrocarbon to surface.

The predominately hydrocarbon component travels in the direction indicated by arrow 34, to exit cyclones 32 through oil outlets 36 that are in fluid communication with oil concentrate tubing 38 that extends upwards to the head of well 10. In this embodiment, gas-lift string 40 is provided to deliver lift gas flowing in the direction indicated by arrow 42, through one or more conventional gas-lift valves 44 spaced along the length of oil concentrate tubing 38, to aid in the lifting of the predominately hydrocarbon component to surface. Alternative arrangements for lifting the oil to surface will be apparent to those skilled in the art. Any kind of artificial lift method may be used including, but not limited to, beam pump systems, progressive cavity pump systems, electrical submersible pump systems, and hydraulic pump systems. In other wells where the eruptive force of the well is sufficient to lift the produced fluids up the well naturally, artificial lift systems may not be utilized.

The predominately water component of produced fluids exits cyclone 32 and travels in the direction indicated by arrow 46 to discharge into housing 28 of separator 24. Inside separator housing 28 is located a jet pump 50 illustrated schematically and includes ports 52 around its circumference that allow the downhole-separated predominately water component, flowing in the direction indicated by arrow 54, to enter jet pump 50. Alternative pumps suitable for use in the present invention include, but are not limited to, progressive cavity pumps, turbine pumps and reciprocating pumps. These pumps are listed for illustrative purposes and the invention may be implemented with other types of pumps. In another embodiment, a pump and motor combination is used. In this embodiment, jet pump 50 is sealed in the bottom of power fluid tube 56 that passes through housing 28 and extends from jet pump 50 to upper annular sealing packer 58 which is equipped with gas burp valve 68 for injecting free gas contained in the wellbore below packer 58 into oil concentrate tubing 38. Power fluid tube 56 is equipped with check valve 57. Upper sealing annular packer 58 isolates produced fluids from annular space 60 located between wellbore casing 12 and oil concentrate tubing 38. Surface water, flowing in the direction indicated by arrow 62, is injected down wellbore casing 12 through annular space 60 and enters jet pump 50 through power fluid tube 56. Surface water flowing in the direction indicated by arrow 63 acts as a power fluid for jet pump 50 and the downhole-separated predominately water component flowing in the direction indicated by arrow 54 acts as a suction fluid for jet pump 50. In a preferred embodiment, surface water is presurized with a pump located at the surface. In yet another embodiment of the present invention, the surface water is used as motive power for the downhole pump comprising a fluid motor and injection pump combination. Surface water and the downhole-separated predominately water component of produced fluids is commingled by jet pump 50 into a combined fluid. The combined fluid exits the bottom of oil-water separator housing 28 through water disposal string 64, equipped with choke 66, and flows in the direction indicated by arrow 67. Water disposal string 64 passes through lower annular sealing packer 22 and extends from jet pump 50 to injection zone 16. Combined water is directed through water disposal string 64 to a downhole injection zone 16 by way of the pump. Injection zone 16 can be above or below or adjacent to production 14.

In FIG. 3, another embodiment of the present invention is disclosed in which surface water is delivered to the downhole fluid-driven pump by way of a tube extending from the head of the well to the pump, and the predominately hydrocarbon component of the produced mixture is delivered to the head of the well by way of an annular space located within the well. Elements previously described above for FIG. 1 and FIG. 2 have been given the same reference number.

Surface water, flowing in the direction indicated by arrow 62, is delivered to jet pump 50 by way of power fluid tube 70 that extends from the head of well 10 to jet pump 50. Alternative pumps suitable for use in the present invention include, but are not limited to, progressive cavity pumps, turbine pumps and reciprocating pumps. These pumps are listed for illustrative purposes and the invention may be implemented with other types of pumps. In another embodiment, a pump and motor combination is used. The downhole-separated predominately hydrocarbon component travels in the direction as indicated by arrow 34, to exit cyclones 32 through oil outlets 36 that are in fluid communication with oil concentrate conduit 72 that extends from oil water separator 24, shown in detail in FIG. 4, to the upper annular sealing packer 58. Upper annular sealing packer 58 is equipped with gas burp valve 68 for injecting gas contained in the wellbore below packer 58 into the oil concentrate conduit 72. Above the packer, the predominately hydrocarbon component is discharged into annular space 60 located between wellbore casing 12 and power fluid tube 70, and is transported to the head of well in the direction as indicated by arrow 74.

In this embodiment, gas-lift string 76 extends from the head of well 10 into annular space 60 and is provided to deliver lift gas in the direction indicated by arrow 42, to annular space 60, through one or more conventional gas-lift valves 44 spaced along the length of gas-lift string 76. Alternative arrangements for lifting the oil to surface will be apparent to those skilled in the art. Any kind of artificial lift method may be used including, but not limited to, beam pump systems, progressive cavity pump systems, electrical submersible pump systems, and hydraulic pump systems. In other wells where the eruptive force of the well is sufficient to lift the produced fluids up the well naturally, artificial lift systems may not be required to be utilized.

An important aspect of the present invention is that sufficient injection pressure for the downhole injection of surface water and the downhole-separated predominately water component is obtained by way of the downhole fluid-driven pump. The pump increases the pressure of the downhole-separated predominately water component from the pressure of the produced fluids at the intake of the oil-water separator. Yet another important aspect of the present invention is the variable tubing configuration for maximizing production of the well. In the preferred embodiment of FIG.1, a dedicated conduit is used for flow of the predominately hydrocarbon component to surface while in a preferred embodiment of FIG. 3, an annular space is for flow of the predominately hydrocarbon component to surface. The latter embodiment can allow for larger production flow diameter and higher flow capacity. Those skilled in the art will appreciate that the wellbore completion may vary in design in order to accommodate flow of produced fluids from a downhole formation as well as injection of fluids from surface in different configurations.

While the invention had been described with reference to certain embodiments, it is to be understood that the description is made only by way of example and that the invention is not to be limited to the particular embodiments described herein and that variations and modifications may be implemented without departing from the scope of the invention as defined in the claims hereinafter set out.

What is claimed is:

1. In a well producing a hydrocarbon and water mixture from an underground formation, a method for the downhole separation of water contained in the produced mixture and the simultaneous injection of downhole separated water and surface water, the method comprising the steps of:

(a) delivering surface water to a downhole jet pump under pressure so as to drive the pump;

(b) separating said mixture obtained from a production formation into a predominately water component and a predominately hydrocarbon component and directing the predominately water component to the pump, by way of the pump;

(c) combining the surface water and predominately water component to obtain a combined fluid and directing the combined fluid into a downhole injection formation by way of the pump.

2. The method of claim 1, wherein the separating takes place in a location different from the location of the pump.

3. The method of claim 1, wherein the pump is deployed by wire line.

4. In a well producing a hydrocarbon and water mixture from an underground formation a system for the downhole separation of water contained in the produced mixture and the simultaneous injection of downhole separated water and surface water, the system comprising:

(a) a downhole oil-water separator for separating the produced mixture into a predominately hydrocarbon component and a predominately water component, and having at least one inlet to receive the produced mixture, at least one outlet for the predominately hydrocarbon component of the mixture to pass from the separator, and at least one outlet for the predominately water component of the mixture to pass from the separator;

(b) a downhole jet pump for receiving surface water under pressure so as to drive the pump, in fluid communication with the separator outlet for the predominately water component of the produced mixture to permit combination of the predominately water component and the surface water as a combined fluid, and comprising an outlet oriented to permit direction of the combined fluid into a downhole formation.

5. The system of claim 4, wherein the pump is located outside the housing of the separator.

6. The system of claim 4, wherein the separator and the pump are at different locations within the well.

7. The system of claim 6, wherein the separator is located below the producing formation and the pump is above the producing formation.

8. The system of claim 6, wherein the pump is located below the producing formation and the separator is above the producing formation.

9. The system of claim 4, wherein the pump is deployed by wire line.

* * * * *